US005599102A

United States Patent [19]

Hamada et al.

[11] Patent Number: 5,599,102

[45] Date of Patent: Feb. 4, 1997

[54] DEVICE FOR CONTINUOUSLY MIXING LIQUID AND POWDER WITH A SECOND STAGE LIQUID FEED LINE AND NOTCHED SCRAPER

[75] Inventors: Mitsuo Hamada, Chiba Prefecture; Hideyuki Mori, Fukui Prefecture, both of Japan

[73] Assignee: Dow Corning Toray Silicone Co., Ltd., Tokyo, Japan

[21] Appl. No.: 492,261

[22] Filed: Jun. 19, 1995

[30] Foreign Application Priority Data

Jun. 19, 1994 [JP] Japan ..... 6-139056

[51] Int. Cl.[6] ..... B01F 7/26

[52] U.S. Cl. ..... 366/178.1; 366/303; 241/46.017; 241/46.08

[58] Field of Search ..... 366/168.1, 171.1, 366/172.1, 172.2, 174.1, 178.1, 178.3, 181.4, 303, 304, 306, 307, 309, 312, 317; 241/46.017, 46.08

[56] References Cited

U.S. PATENT DOCUMENTS

| | | | |
|---|---|---|---|
| 3,480,213 | 11/1969 | Shelton, Jr. | 241/46.01 X |
| 3,871,625 | 3/1975 | Iwako . | |
| 3,998,433 | 12/1976 | Iwako | 366/304 X |
| 4,096,587 | 6/1978 | Haller | 366/178.1 X |
| 4,175,873 | 11/1979 | Iwako et al. | 366/304 X |
| 4,195,659 | 4/1980 | Barthelmes et al. . | |
| 4,416,548 | 11/1983 | Carre et al. | 366/307 X |
| 4,691,867 | 9/1987 | Iwako et al. | 241/46.08 X |

FOREIGN PATENT DOCUMENTS

| | | | |
|---|---|---|---|
| 5338828 | 10/1978 | Japan . | |
| 55-129139 | 10/1980 | Japan . | |
| 60-209234 | 10/1985 | Japan | 366/317 |
| 60-209233 | 10/1985 | Japan | 366/317 |
| 1262935 | 10/1989 | Japan . | |
| 22610 | 1/1990 | Japan . | |
| 91/07223 | 5/1991 | WIPO | 366/304 |

OTHER PUBLICATIONS

JP90002610–Abstract.

*Primary Examiner*—Charles E. Cooley
*Attorney, Agent, or Firm*—Roger H. Borrousch

[57] ABSTRACT

A device for continuously mixing liquid and powder is able to provide lower apparent viscosities for liquid-powder mixtures. The device allows introduction of a fresh supply of liquid in a second stage mixing chamber where a rotating disk further creates subdividing effects. This second stage mixing chamber contains scrapers with some having notches which help improve the powder dispersion in the resulting mixture.

3 Claims, 2 Drawing Sheets

DEVICE FOR CONTINUOUSLY MIXING LIQUID AND POWDER WITH A SECOND STAGE LIQUID FEED LINE AND NOTCHED SCRAPER

BACKGROUND OF THE INVENTION

1. Field of the Invention

This invention relates to a device for continuously mixing liquid and powder (hereinafter referred to as a continuous liquid-powder mixer). More specifically, this invention relates to a continuous liquid-powder mixer that is able to generate lower apparent viscosities for liquid-powder mixtures and in particular is highly adapted for the preparation of low-viscosity products in the area of compounds comprising the blends of powder fillers in liquid polymers such as liquid silicones.

2. Description of the Prior Art

Liquid silicone rubber compounds are employed in molding operations such as injection molding, compression molding, and the like, and are also used in various other operations as materials, such as moldmaking materials, architectural and building sealants. Liquid silicone rubber compounds are viscous mixtures of liquid silicone with a powder filler such as reinforcing silica. As is well known, lower apparent viscosities for these compounds provide a better processability in the aforementioned operations, while higher apparent viscosities impair the processability.

Liquid silicone rubber compounds with low apparent viscosities are prepared by mixing so as to give the highest possible dispersion of the powder filler that is being blended into the liquid silicone rubber. Compact devices that efficiently mix liquid and powder are disclosed in Japanese Patent Publication Numbers Sho 53-38828 [38,828/1978] and Hei 2-2610 [2,610/1990]. These are continuous mixers that contain a scraper-equipped rotating disk installed within a casing so as to divide the interior of the casing into upper and lower mixing compartments.

However, at high compounding ratios for microparticulate fillers such as fumed silica, i.e., at compounding ratios as high as approximately 10%, it is almost impossible using these prior-art devices to rapidly and inexpensively achieve an apparent viscosity for the compound (mixture) low enough to avoid negative consequences for the processability during molding.

SUMMARY OF THE INVENTION

Problems to be Solved by the Invention

The present invention takes as its object the introduction of a continuous liquid-powder mixer that is able to provide lower apparent viscosity values for liquid-powder mixtures.

An additional object of the present invention is the introduction of a continuous liquid-powder mixer that is able to blend larger amounts of powder for a given liquid-powder mixture viscosity.

Means Solving the Problems

In a continuous mixing device comprising a feed opening for the introduction of liquid and powder resides on the top of a casing and a discharge outlet is installed on the bottom of said casing, a rotating disk is installed within the casing and thereby divides the interior of the casing into upper and lower mixing compartments, and scrapers are fixed on both the upper and lower surfaces of said rotating disk, wherein the improvement comprises the device for continuously mixing liquid and powder in which a liquid feed line is connected to the lower mixing compartment, a ring plate is installed on the inside wall of the lower mixing compartment, notches are furnished in the scrapers on the lower surface of the rotating disk, end the inner edge of said ring plate is contactlessly inserted into said notches in such a manner that the scrapers, while in this interpenetrated condition, are able to move relative to the ring plate.

BRIEF DESCRIPTION OF THE DRAWINGS

Description of the Figures

Figure 1:
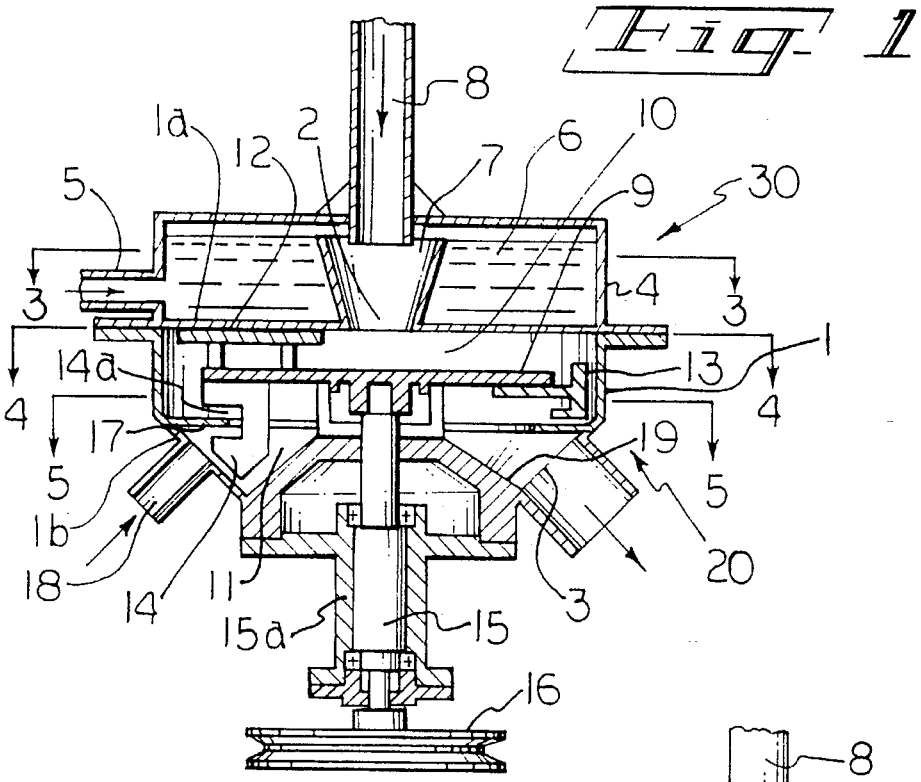

FIG. 1 contains a vertical cross section of a continuous mixer provided as an example of the instant invention.

Figure 2:
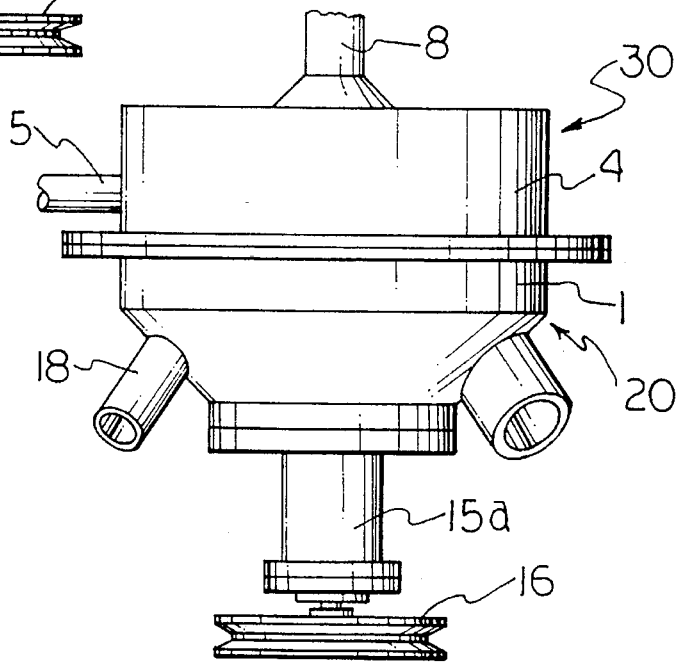

FIG. 2 contains a profile view of the continuous mixer of FIG. 1.

Figure 3:
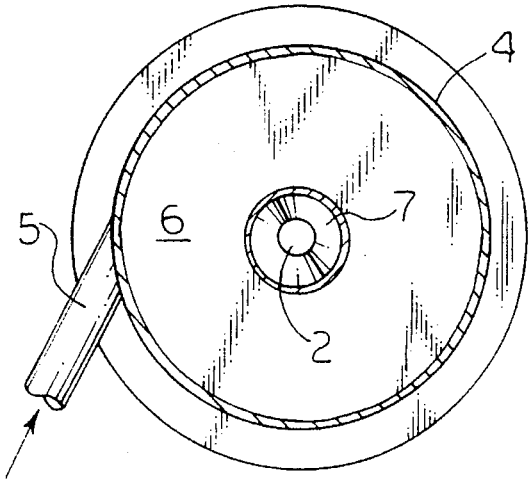

FIG. 3 contains the cross section at the 3—3 level in FIG. 1.

Figure 4:
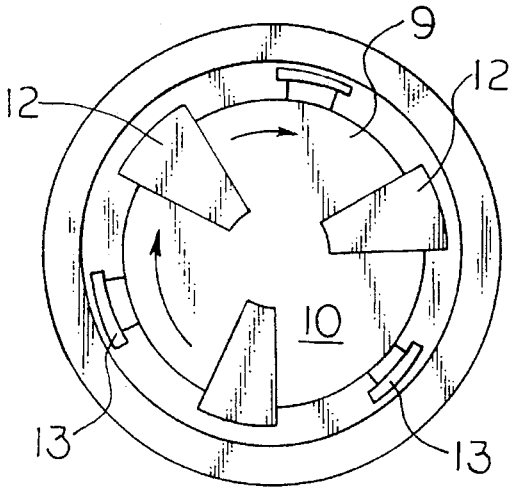

FIG. 4 contains the cross section at the 4—4 level in FIG. 1.

Figure 5:
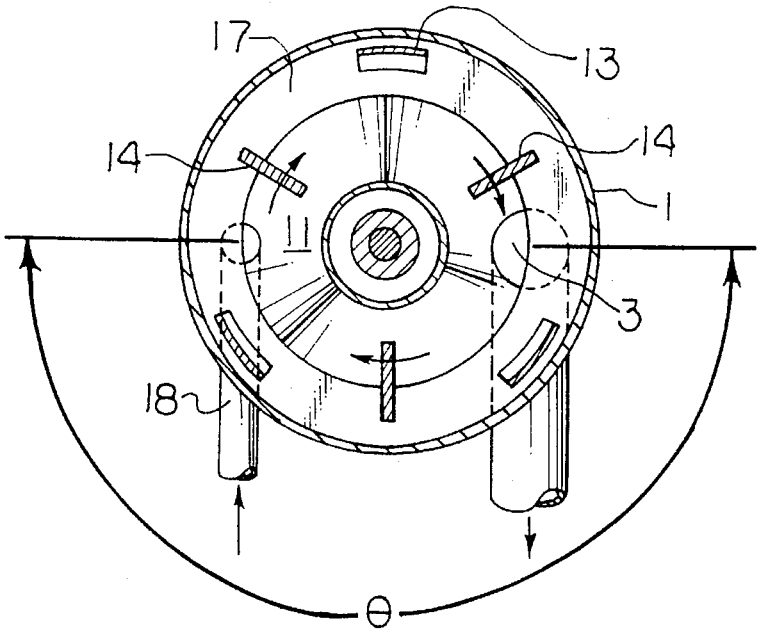

FIG. 5 contains the cross section at the 5—5 level in FIG. 1.

| Explanation of the Reference Numbers | |
|---|---|
| 1 | casing |
| 1a | center of upper plate |
| 1b | inclined surface |
| 2 | feed opening |
| 3 | discharge outlet |
| 4 | cylindrical casing |
| 5 | liquid feed lines |
| 6 | liquid reservoir |
| 7 | overflow tube |
| 8 | powder feed conduit |
| 9 | rotating disk |
| 10 | upper mixing compartment |
| 11 | lower mixing compartment |
| 12 | scrapers |
| 13 | scrapers |
| 14 | scrapers |
| 14a | notches |
| 15 | rotating shaft |
| 15a | shaft bearing |
| 16 | pulley |
| 17 | ring plate |
| 18 | liquid feed lines |
| 19 | conical element |
| 20 | mixer body |
| 30 | starting material feed section |

DETAILED DESCRIPTION OF THE PREFERRED EMBODIMENTS

In the continuous mixing device, the liquid and powder introduced into the upper mixing compartment are subjected to a first-stage mixing process by the scrapers installed on the upper surface of the rotating disk. The resulting mixture is then transferred into the lower mixing compartment, where it is subjected to a second-stage mixing process by the scrapers installed on the lower surface of the rotating disk. In this second-stage mixing process, the liquid/powder mixture is subjected to strong shear between the ring plate and the notches in the scrapers as the mixture flows down onto the ring plate. This strong shear improves the quality of the powder dispersion. The apparent viscosity is substantially reduced as a result of this improved dispersion and as a result of the fresh liquid supplied into this zone from the liquid feed line.

Liquids which may be subjected to the present invention are exemplified by water, liquid candy with a starch base, edible oils, liquid chemical compounds, liquid polymers, and so forth. The liquid polymers are exemplified by liquid silicones, liquid polybutadienes, liquid epoxy resins, and so forth. The powders are exemplified by wheat flour, metal powders, powder fillers, and so forth, and the powder fillers are themselves specifically exemplified by fumed silica, wet-process silica, calcium carbonate, carbon black, end the like.

The continuous mixer according to the present invention is effectively applied to viscous liquids whose viscosity is further raised by the admixture of powder, and it is particularly effectively applied to the production of silicone rubber compounds in which microparticulate filler is blended in large quantities into a liquid polymer such as liquid silicone.

The instant invention will be explained in greater detail hereinafter with reference to the example in the drawings.

FIG. 1 contains the vertical cross section and FIG. 2 contains the profile of a continuous mixer according to the present invention. FIGS. 3 through 5 contain cross sections at the 3—3, 4—4, and 5—5 lines, respectively, in FIG. 1.

In the figures, 20 refers to the mixer body and 30 refers to the starting material feed section for the mixer. A cylindrical casing 1 forms the outer shell of mixer body 20, and a feed opening a that receives liquid/powder mixture is installed at the center of the upper plate 1*a* of this casing. The lower part of the casing 1 forms an inclined surface 1*b* having the shape of an inverted cone, and a discharge outlet 3 is installed in said inclined surface 1*b*. A conical element 19 is installed at the center of the bottom of the casing 1 so as to form an annular V-shaped bottom with the inclined surface 1*b*.

A cylindrical casing 4 forms the outer shell of the starting material feed section 30. A liquid feed line 5 is connected tangentially at the side of casing 4, and a liquid reservoir 6 is formed within casing 4. An overflow tube 7 having the shape of an inverted cone is connected on the top of the feed opening 2 on the mixer body 20. This overflow tube 7 ascends vertically into the liquid reservoir 6. The lower end of a powder feed conduit 8 faces the inlet to the overflow tube 7.

The starting viscous liquid is fed into the starting material feed section 30 through the liquid feed line 5, while the starting powder is fed from the powder feed conduit 8. The liquid supplied from the liquid feed line 5 is first scored in the liquid reservoir 6 in the starting material feed section 30 and then flows down along the inner wall of the overflow tube 7 from its top edge. At this point the liquid is mixed with the powder supplied through the powder feed conduit 8 and descends into the feed opening 2.

A rotating disk 9 is horizontally installed within the casing 1 of the mixer body 20 so as to face the feed opening 2. This rotating disk 9 divides the interior of the casing into an upper mixing compartment 10, where the first-stage mixing operation is implemented, and a lower mixing compartment 11, where the second-stage mixing operation is implemented. The center of rotation of this rotating disk 9 is fixed on the upper end of a rotating axle 15. Said rotating axle 15 is supported by an axle bearing 15*a* and extends to the exterior of the casing 1. A pulley 16 is fixed at the bottom end of the rotating axle 15, and the power for rotation is input from a motor (not shown) across this pulley 16. The preferred range for the rotation rate is 400 to 1,500 rpm.

The upper surface, outside edge, and lower surface of the rotating disk 9 each carry three scrapers separated by equal angles (the scrapers in each set are respectively designated by 12, 13, and 14), and the mixture is mixed through the stirring and scraping actions of these scrapers. Mixing occurs as follows: the scrapers 12 in the upper mixing compartment 10 scrape off the mixture adhering to the top plate 1*a;* the scrapers 13 scrape off the mixture adhering on the inner wall of the casing at the boundary between the upper mixing compartment 10 and the lower mixing compartment 11; and the scrapers 14 in the lower mixing compartment 11 scrape off the mixture adhering on the inclined surface 1*b* of the casing bottom.

The mixer need not have 3 scrapers in each set 12, 13, and 14 as shown in the drawings, and any number from 1 on may be employed. Moreover, the scraper sets may all contain the same number of scrapers or may contain different numbers of scrapers, and the scrapers 13 on the outer edge of the rotating disk 9 may even be omitted as desired. The upper surface of the rotating disk 9 may as necessary also bear a large number of vertical pins, which through their stirring activity will further promote stirring and mixing.

The following structures are installed in the lower mixing compartment 11 in order to obtain an even greater mixing effect.

First, a liquid feed line 18 is attached tangentially to the side wall of the lower mixing compartment 11. This tangential attachment to the casing side wall functions to promote the mixing effect exercised by the liquid on the mixture within the casing. The installation position of this liquid feed line 18 preferably defines an open angle theta, measured from the discharge outlet 3 along the direction of rotation of the rotating disk 9, in the range from 180° to 270°. This facilitates the improvement in mixing effect that is due to the incoming liquid.

The scrapers 14 installed in the lower mixing compartment 11 comprise plates or mesh plates that extend both radially and vertically, and notches 14*a* of the scrapers 14 are installed therein that run radially inward from the outside edge. A ring plate 17 is fixed on the inner wall of the casing 1 facing the position of the notches 14*a,* and the inner edge of this ring plate 17 is interpenetratingly inserted into the notches 14*a*. The notches 14*a* stretch horizonally over a surface of the ring plate 17 which is set in narrow spaces of notches 14*a*.

The operation of the instant continuous mixer wall now be described. The liquid/powder mixture entering the upper mixing compartment 10 from the feed opening 2 is subjected, while being radially transported to the outside of the rotating disk 9, to the first-stage mixing process based on stirring and scraping by the scrapers 12. Due to the structure described above for the lower mixing compartment 11, the mixture from the first-stage mixing process descends across the outer edge of the rotating disk 9 onto the ring plate 17, where it is strongly processed and sheared between the ring plate 17 and the narrow notches 14*a* in the scrapers 14. This shearing is all the more forceful because it occurs between narrow notches 14*a* and the ring plate 17, and the powder becomes even more uniformly dispersed in the liquid as a result.

After shearing on the ring plate 17, the mixture then descends onto the inclined surface 1*b* and is sheared while being scraped by the ends of the scrapers 14. The resulting additional dispersion of the powder induces a further lowering of the apparent viscosity of the mixture. Prior to mixture discharge through discharge outlet 3, the fresh supply of starting liquid from the liquid feed line 18 and its shear by the scrapers 14 furnishes an additional lowering of the viscosity.

The above-described continuous mixer is therefore able to provide a quite substantial reduction in the apparent viscosity of the mixture, even when large quantities of powder are to be compounded into the liquid.

EXAMPLES

An invention device, comparison device 1, and comparison device 2 (characteristics described below) were each used to prepare a low-viscosity silicone rubber compound by blending 10 weight parts hydrophobic fumed silica (Aerosil R-972 from Nippon Aerosil Kabushiki Kaisha) into 100 weight parts hydroxyl-endblocked polydimethylsiloxane (viscosity at room temperature=15 Pa.s).

The apparent viscosity at a shear rate of 50 $sec^{-1}$ was measured on each of the 3 silicone rubber compounds thus obtained using a flow tester (nozzle diameter=1 mm, tube length=10 mm, load=2 kg). These results were as reported in Table 1.

The results confirmed that, relative to the comparison devices, the continuous mixer according to the instant invention was able to produce the lowest viscosity at the same starting material mixing ratio.

Device According to the Instant Invention

Structure:

according to FIGS. 1 through 5 diameter of the rotating disk: 300 mm rotation rate of the rotating disk: 900 rpm width of ring plate: 30 mm open angle between the discharge outlet 3 and the liquid feed line 18: 180°

Feed Method:

The 10 weight parts hydrophobic fumed silica was charged through the powder feed conduit 8, while the feed of the 100 weight parts hydroxyl-endblocked polydimethylsiloxane was subdivided into 60 weight parts through the liquid feed line 5 and 40 weight parts through the liquid feed line 18 to the lower mixing compartment 11.

Comparison Device 1

Structure:

device according to FIGS. 1 to 5, but which contained neither the ring plate 17 nor the liquid feed line 18 (corresponds to prior-art device)

diameter of rotating disk: 300 mm rotation rate of rotating disk: 900 rpm

Feed Method:

The 10 weight parts hydrophobic fumed silica was fed through the powder feed conduit 8, and the 100 weight parts hydroxyl-endblocked dimethylpolysiloxane was fed through the liquid feed line 5.

Comparison Device 2

Structure:

device according to FIGS. 1 to 5, but which lacked only the ring plate 17 diameter of the rotating disk: 300 mm rotation rate of the rotating disk: 900 rpm open angle between the discharge outlet 3 and the liquid feed line 18: 180°

Feed Method:

The 10 weight parts hydrophobic fumed silica was charged through the powder feed conduit 8, while the feed of the 100 weight parts hydroxyl-endblocked dimethylpolysiloxane was subdivided into 60 weight parts through the liquid feed line 5 and 40 weight parts through the liquid feed line 18 to the lower mixing compartment 11.

TABLE 1

| | Apparent Viscosity, Pa · s |
|---|---|
| Device of the present invention | 70 |
| Comparison Device 1 | 140 |
| Comparison Device 2 | 130 |

Effects of the Invention

One distinctive feature of the continuous mixer according to the instant invention is the fresh supply of liquid through the installation of a liquid feed line into the lower mixing compartment created by the subdividing effect of the rotating disk. Another distinctive feature consists of the provision of notches in the scrapers in this lower mixing compartment and the configuration of these notches in such a manner that the inner edge of the ring plate installed on the inner casing wall is interpenetratingly inserted into the notches. As a result, the continuous mixer according to the instant invention is able to generate a substantial reduction in the apparent viscosity of mixtures (i) due to an improved powder dispersion generated by the strong shear exercised on the mixture between the notches and ring plate and (ii) due to the fresh liquid feed into this zone.

The continuous mixer according to the instant invention is therefore able to produce lower viscosity products for a given powder addition and is also able to blend larger amounts of powder for a given viscosity value.

That which is claimed is:

1. A continuous mixing device having a top and a bottom in which a feed opening (2) for the introduction of both liquid and powder resides on the top of a casing (1) and a discharge outlet (3) is installed on the bottom of said casing, a rotating disk (9) having an upper surface and a lower surface is installed within the casing (1) and thereby divides an interior of the casing (1) into an upper mixing compartment and a lower mixing compartment, and scrapers are fixed on both the upper and lower surfaces of said rotating disk, a liquid feed line is connected to the lower mixing compartment, a ring plate is installed on an inside wall of the lower mixing compartment, notches are furnished in the scrapers on the lower surface of the rotating disk, and an inner edge of said ring plate is contactlessly inserted into said notches in such a manner that the scrapers, while in this interpenetrated condition, are able to move relative to the ring plate.

2. Device according to claim 1 for continuously mixing liquid and powder, in which a vertically ascending overflow tube (7) for liquid feed is connected to the feed opening (2) on the top of the casing (1) and a powder feed conduit (8) faces an entrance to said overflow tube (7).

3. A method of continuously mixing a liquid and a powder comprising continuously feeding a viscous liquid and a powder into an upper mixing compartment (10) where the liquid and powder are continuously mixed forming a first mixture in a first-stage mixing operation by a rotating disk which divides the upper mixing compartment (10) from a lower mixing compartment (11), the first mixture continuously passes into the lower mixing compartment (11) by first scraper means on a rotating disk (9) which provides stirring and scraping action radially transporting the first mixture outside of the rotating disk into the lower mixing compartment (11) where the first mixture is strongly sheared by notches in second scraper on the rotating disk means and mixed with a fresh supply of a viscous liquid continuously producing a second mixture.

* * * * *